US006979286B1

(12) United States Patent
Hinds

(10) Patent No.: US 6,979,286 B1
(45) Date of Patent: Dec. 27, 2005

(54) EXERCISE BAR AND CORD ASSEMBLY

(75) Inventor: Robert Sylvester Hinds, Madison, WI (US)

(73) Assignee: Douglas C. Terry, Salt Lake City, UT (US)

( * ) Notice: Subject to any disclaimer, the term of this patent is extended or adjusted under 35 U.S.C. 154(b) by 362 days.

(21) Appl. No.: 10/184,239

(22) Filed: Jun. 26, 2002

(51) Int. Cl.[7] ..... A63B 21/02
(52) U.S. Cl. ..... 482/121; 482/126; 482/125
(58) Field of Search ..... 482/126, 121–125, 482/127–129, 81, 82, 49

(56) References Cited

U.S. PATENT DOCUMENTS

| | | | | |
|---|---|---|---|---|
| 437,822 | A | 10/1890 | Reach | |
| 2,448,384 | A | 8/1948 | Meinzinger | |
| 3,117,781 | A | 1/1964 | Vargo | |
| 3,256,015 | A | 6/1966 | Perrin | |
| 3,355,171 | A | 11/1967 | Oesau | |
| 4,059,265 | A | 11/1977 | Wieder et al. | |
| 4,245,839 | A | 1/1981 | Trent | |
| 4,316,610 | A | 2/1982 | Hinds | |
| 4,328,964 | A | 5/1982 | Walls | |
| 4,779,867 | A * | 10/1988 | Hinds | 482/126 |
| 5,549,532 | A * | 8/1996 | Kropp | 482/126 |
| 5,637,066 | A * | 6/1997 | Chang | 482/126 |
| 5,800,322 | A * | 9/1998 | Block | 482/126 |
| 5,846,170 | A * | 12/1998 | Ho | 482/125 |
| 6,398,698 | B1 | 6/2002 | Hinds | |

* cited by examiner

*Primary Examiner*—Jerome W. Donnelly
(74) *Attorney, Agent, or Firm*—Holme Roberts & Owen LLP

(57) ABSTRACT

An exercise bar and cord assembly having a cavity or nest at each end of the bar for connection with a snugly fitting cord emplacement block. The exercise cord, stoppered with a plug in conventional manner, is connected to the block, extending through a tunnel within it. The block may be shaped in any of several ways and a strapped handgrip connection block will serve the purpose. Emplacement channels or slots are optionally present in both the bar and the block. If the block has an axially symmetrical neck, it may be rotated so that the channels are misaligned for improved cord retention. Two modes of exercise are defined in terms of the cord's anchoring means—that is, whether its ends or a mid-portion of it.

20 Claims, 5 Drawing Sheets

EXERCISE BAR AND CORD ASSEMBLY

BACKGROUND OF THE INVENTION

1. Field of the Invention

The present invention relates to exercise equipment.

2. Description of the Prior Art

The lifting of a rod or bar 100 of an exercise bar assembly (FIG. 4) of one sort or another by a user against the resistance of an elastic exercise cord 20 has become an increasingly popular form of exercise.

In one prior art arrangement, the ends of the elastic cord 20 are anchored in some manner with one mid-portion run through or suitably seated upon the bar. The bar may then be tugged in a beneficial manner. The cord ends may terminate at any improvised connection system—for example, either a strap impinged in the crack of a door or in anyone of several securing mechanisms present on a wall mounted assembly. The cord ends may even have handgrips 120 connected to them. The operator may put his or her feet the handgrips to hold them and stretch the cord's mid-portion upwards by appropriate use of the bar 100. In another arrangement, the ends of the cord are securely connected to the exercise bar 100. The mid-portion of the cord may be secured at a door or wall by any means. The mid-portion of the cord may also be self-anchored by standing upon it. In either arrangement, it is quite common for the operator to grasp the opposing ends of the rod or bar 100 and raise it 100, to a point far above his or her head while stretching the cord 20. In either arrangement, the assembly becomes a convenient portable substitute for cumbersome weight lifting apparatus.

It is also known to wrap a portion of the elastic cord around the ends of the exercise bar 100 in order to shorten the cord's length. The technique could be employed in either of the two modes of exercise operation. If the cord's mid-portion, for example, were along or within the bar 100, opposing portions of the cord would be wrapped or twisted about the bar 100 ends. If cord ends are connected to the bar itself 100, cord 20 may be wrapped about the bar at its ends. The undertaking of that convenience to effectually shorten cord length came at a cost, however. Wrapping of the cord at the bar 100 ends, resulted in a torque built up or a twisting force which the operator had to resist. That unwanted force tended to diminish the ordinarily sought-after benefits from operation of an elastically anchored lifting bar 100 in either mode of exercise.

U.S. Pat. No. 437,822 (Reach) shows a tug-of-war belt about which a rope would wrap. The belt does not have a bar 100 or an elastic cord. U.S. Pat. No. 4,245,839 (Trent) shows a tugging belt with the cord ends terminating in a door crack impingement. U.S. Pat. No. 2,448,384 (Meinzinger) shows a device to grasp a fishing line. U.S. Pat. No. 4,328,964 (Walls) discloses a handle, similar to a tennis racquet or golf club, with elastic cords connected to a door jam. The operator was to stretch the elastics by moving the handle. U.S. Pat. No. 4,195,835 (Hinds, et al.) and U.S. Pat. No. 4,316,610 (Hinds) show an exercise bar 20 featuring means to effectually shorten a cable 24 by conveniently wrapping opposing sections of the cable around the end of bar 20. In U.S. Pat. No. 4,316,610, pins 92, 93 are provided to move with holes 94–95 to effect joining of opposing sections 90, 91 of the bar.

U.S. Pat. No. 3,355,171 (Oesau) discloses separate chains 14, 16 in lieu of a continuous elastic cord anchored to the anchor bar 12 that the operator stood upon. U.S. Pat. No. 3,117,781 (Vargo) featured a bar 9, in the manner considered here, in which the inextensible cord 17 was anchored into a platform 1 upon which the operator stood. In U.S. Pat. No. 3,256,015 (Perrin), the cord 25 ends are fastened by interweaving them through holes 21 drilled in the extension or bar 20 so that the operator could exercise by standing upon the cord's mid-portion. U.S. Pat. No. 4,059,265 (Wiede, et al.) featured a hollow bar 13 with which connection was accomplished by running the cord 11 ends longitudinally in opposition through passages 15 within the bar 100. Again, the operator stood upon the cord's mid-portion during exercise.

Finally, U.S. Pat. No. 4,779,867 (Hinds) featured an exercise bar 17 with a cord 11 anchored to the ends of the bar 17. Bar 17 was formed in halves joined by a suitable locking mechanism (col. 2, line 65). The bar 17 included a groove 19 along its length for the cable 11. At the ends of the bar 17 are lugs 24 for wrapping the cable 11.

In the '867 Hinds patent, a pair of stirrups 12 are placed within receptacles 30. This arrangement was bulky and the stirrups could be oriented only in a direction transverse to the bar 17 because of the interfering presence of lugs 24.

It would be highly useful to have with us a connector which is not limited in orientation but which could be emplaced in any radial position within a bar end socket regardless of the presence of cord enwrapment pegs.

SUMMARY OF THE INVENTION

In one aspect, the invention is an assembly of an exercise lifting bar and any one of several specially designed emplacement blocks 3 which connect to an elastic cord assembly 2. The emplacement block 3 may take almost anyone of several conceivable forms other than the base of a solid handgrip. One novel embodiment of the block 3 is a strapped handgrip's connection block 130 shaped to fit snugly within a nest 11 in the bar or elongated extension 10. The configuration of this block 130 has a disadvantage in permitting its emplacement in only one directional position. Other blocks 3 are described, however, which may be axially rotated within the nest 11—sockets carved into the ends of the rod 10—so as to be positioned in any direction upon emplacement. The blocks 3 are particularly configured to provide convenience and connective security.

As at prior art, the stick-like or rod-like device 10 is held in the operator's hands and—in either first or second mode exercise—typically lifted upward or tugged against the resistance of an elastic cord 20 in a direction away from an anchoring site situated either remotely from him or her or more proximately, such as when portions of the cord 20 or objects connected thereto 20 are stood upon. The focus thereof is upon second mode exercise—that in which it is the mid-portion of the cord 20 is anchored and its ends 21 which are stretched in exercise. Embodiments are provided for, however, which address well known variations in first mode exercise as well—that is, that in which it is the cord ends 21 which are anchored and the mid-portion which is thus stretched. Certain structural embellishments including nodes 13, impingement sectors 31, and a retaining ledge 16 are present which contribute to acceptable connectability. This mutual configuration permits the two interconnected parts 3, 11 to remain in place after being pressed together and yet requires little effort to yank them 3, 11 apart for other exercise service or convenient stowage.

Optional features dispose at the ends of the bar 10 and within the block 3 cord emplacement channels or slots 14, 34, respectively which facilitate the cord's 20 emplacement into the system.

Although a snap-fit bar separation assembly 400 is not unknown to the art as a portability feature, the improved model here includes a spring 42 and release button 41 version.

While the exercise assembly which is the subject hereof features a patentable combination of members, most of which are familiar to us, they might perhaps equally well be billed as improvements to the prior art model 100. So presented, the number of improvements would be at least two because of the specially shaped emplacement block and the bar's snap-fit mechanism 400 featured herein.

BRIEF DESCRIPTION OF THE DRAWINGS

FIG. 6 shows a conical emplacement nest 111 for mating with a block 3.

DESCRIPTION OF THE PREFERRED EMBODIMENTS

Figure 1:
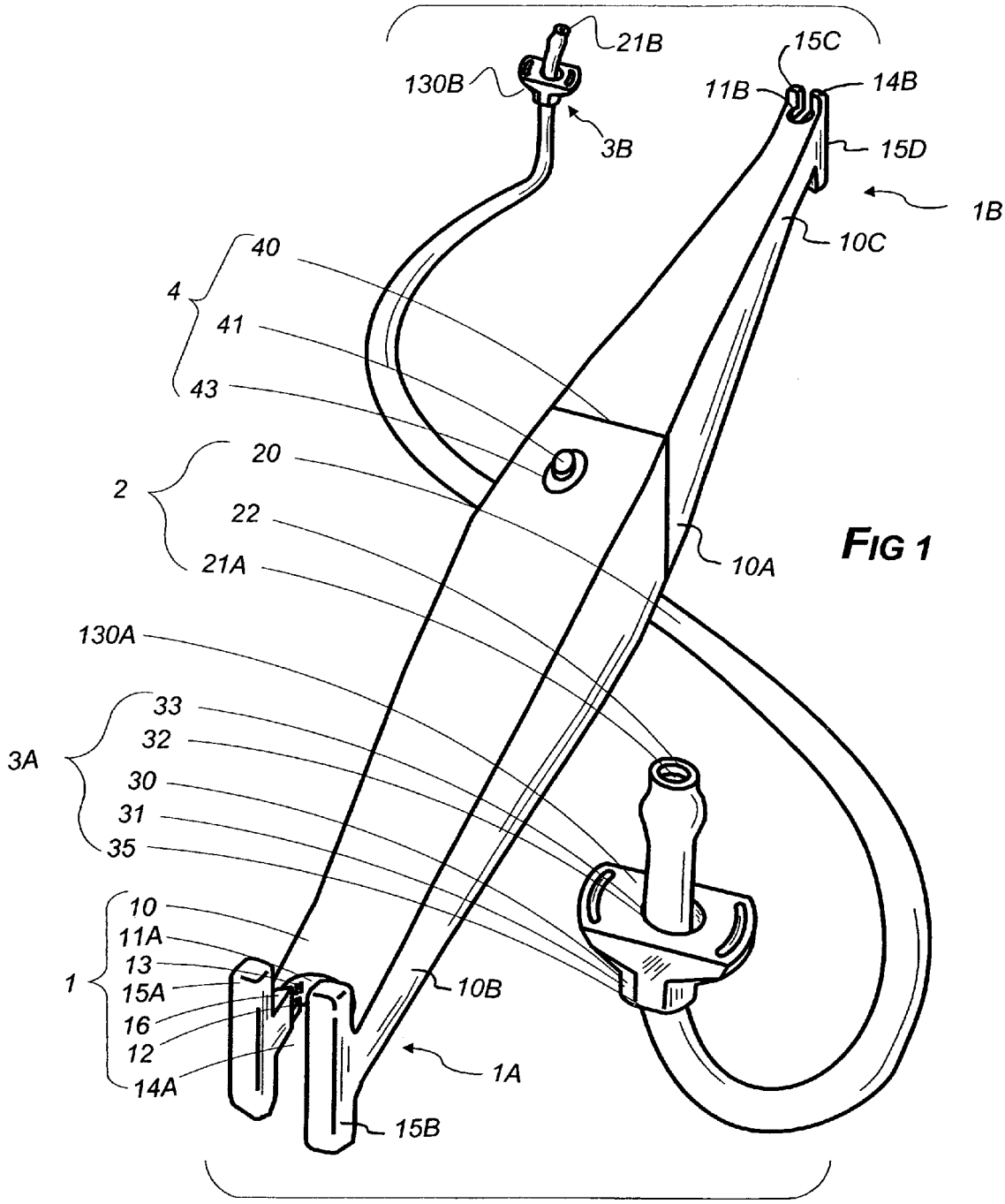
FIG. 1 illustrates an embodiment in which connection blocks 130A and 130B comprise cord emplacement blocks 3. The exercise bar's elongated extension 10 features a bar separation assembly 4 at its 10A mid-portion and cord wrapping pegs 15A and 15B, 15C and 15D at the ends 10B and 10C of the elongated extension 10.

The subject of this application is an exercise cord and bar assembly comprised of an exercise bar end assembly 11A and 11B, an exercise cord assembly 2 and a pair of cord emplacement blocks 130A and 130B.

In simplest form, the first of the three general components, the exercise bar end assembles 11A and 11B, comprise a portion of the elongated extension 10 which is of a general rod-like configuration. The exercise bar end assemblies 11A and 11B include opposing bar emplacement nests 11A and 11B disposed at respective ends thereof. Preferably present, however, are also cord emplacement channels 14A and 14B disposed at each of the extension's ends 10B and 10C and a cord stretching recess 12 disposed longitudinally along the underside of the elongated extension 10 for optional traditional first mode exercise—that is, wrapping part of the mid-portion of the exercise cord 20 around the ends 10B and 10C of the elongated extension's ends 10 to effectually shorten the exercise cord 20 and increase its resistance for lifting type exercises.

In FIG. 1, cord wrapping pegs 15A, 15B, 15C and 15D have been disposed at the ends 10B and 10C for first mode use to provide a stop to keep the cord 20 from slipping off. The connection block 130A and 130B is configured for easy removal because one's fingers may be slipped conveniently underneath to pull one connection blocks 130A and 130B out. Also, the cord emplacement block 3 may be configured with sufficient height so that cord wrapping pegs 15A and 15B become unnecessary. If a block 3 is formed to extend upward above the bar or extension 10 and is firmly impinged within the nest 11A or 11B, the cord 20 wrapping security is essentially equal to that provided by pegs 15A–D—that is, the protrusion provided by the block's 3 upper portion then serves as a reasonable substitute for a peg 15A, 15B, 15C or 15D. Moreover, it should be observed that in the case of the connection blocks 130A and 130B in FIG. 1, the block 3, because of the particular shape of its uppermost portion, cannot be arbitrarily rotated when emplacing and fitting the blocks into one of the nests 11A and 11B. Other than that shown, the only position the block 3 may occupy without interference with the pegs 15A–D in either case is 180 degrees away.

Figure 2:
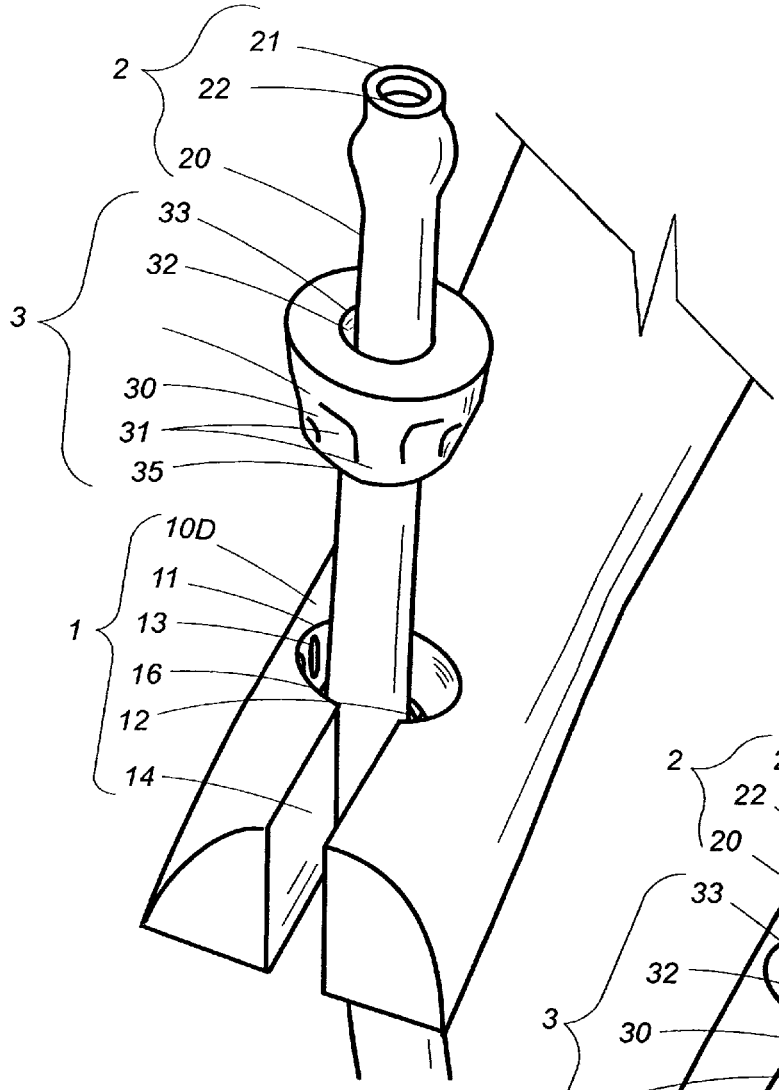
FIGS. 2 and 3 illustrate a cord emplacement block 3 and emplacement nest 11 in which they securely co-engage.
Figure 3:
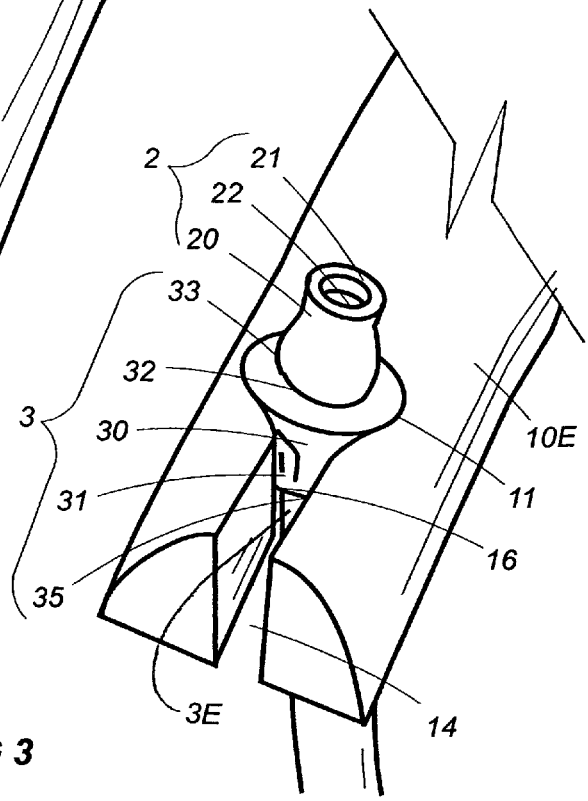

While in the more recent of prior art structures, the elongated extension 10 did include cord wrapping pegs 15, it is feasible to construct the elongated extension 10 without the pegs 15A–D. The configuration for such purpose is designated herein as the continuously contoured projection. The word continuously is expressed to infer the absence of structural discontinuities such as those cord wrapping pegs 15A–1 5C—that is, either a straightly formed object in which the perimeter along any longitudinal cross section extends in a generally straight line, or a smoothly formed or streamlined one comprising slight arcuitry. Changes in curvature along the way are also permitted within the scope of the definition, which immediately distinguishes an elongated extension 10 comprising cord wrapping pegs 15A–D from those elongated extensions 10 which do not. Elongated extensions 10D and 10E comprising continuously contoured projection configuration are illustrated in FIGS. 2 and 3.

Figure 4:
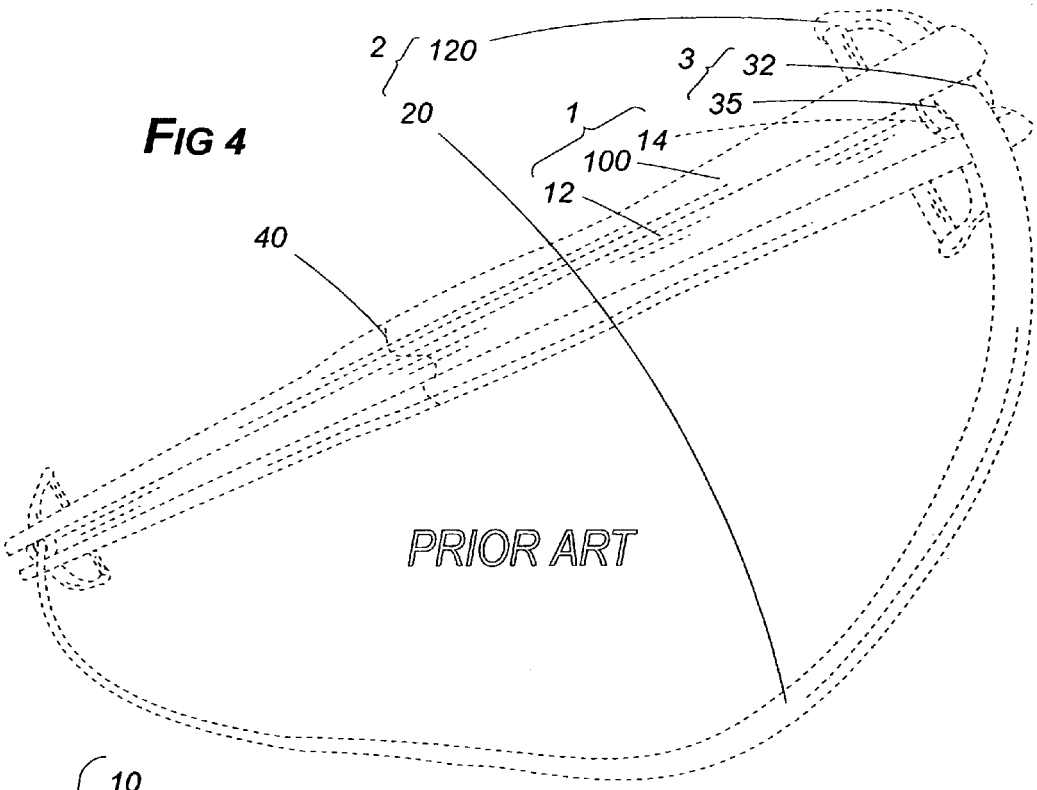
FIG. 4 depicts in perspective a prior art assembly in which the bases or cord connecting ends of a pair of solid stirrup-like handgrip assemblies 120 anchored. The longitudinally extending cord stretching recess 12 revealed shows how the exercise cord 20 becomes seated for first mode exercise.
Figure 5:
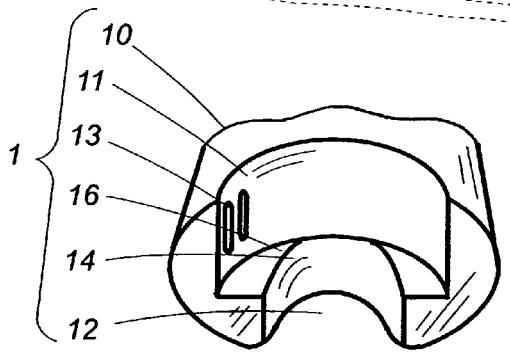
FIGS. 5 and 6 comprise cross-sectional views cut through the cord emplacement channel 14 of two distinct embodiments. In the former, the emplacement nest 11 includes a block retaining ledge 16 serving as a stop for a given block 3.
Figure 14:
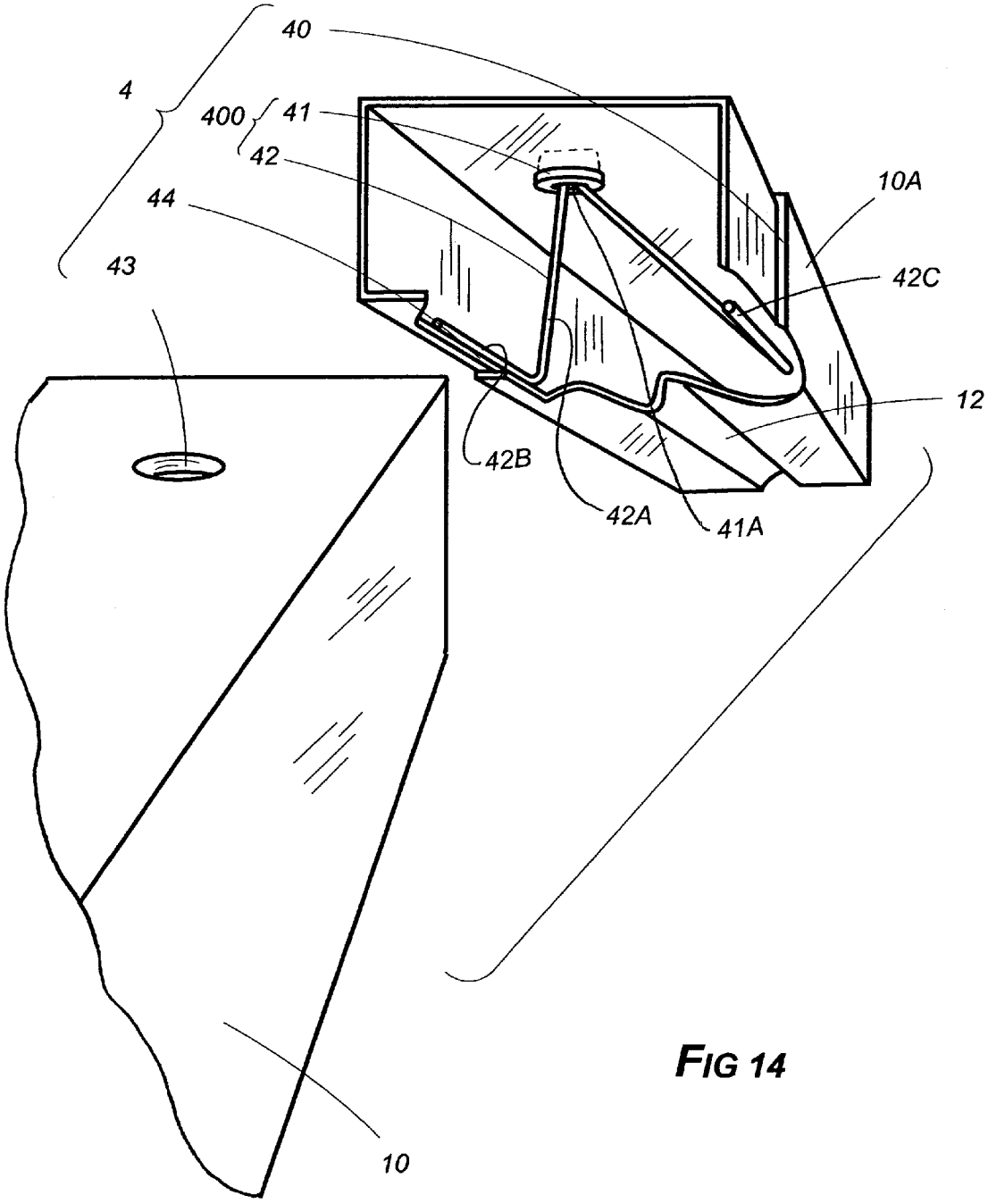
FIG. 14 depicts a perspective view of opposing parts of the exercise bar's elongated extension 10 with a bar separation assembly 4 comprising snap-fit means 400 in which a bar separation button 41 is depressed through a button opening 43 and against a grasshopper leg spring 42 seated within to permit the extension 10 parts to be slid away from one another.

FIG. 14 discloses in detail a bar separation assembly 4. The presence of this preferred feature is also indicated in FIGS. 1 and 4. The bar separation assembly 4 forms a bar separation seam 40 and includes a button opening 43 and snap-fit means of connection 400 (FIG. 14). Herein, the snap-fit of connection 400 preferably comprises a release button 41 and an exercise bar grasshopper separation spring 42 connected both to the release button 41 and a separation spring seat 44.

The bar separation seam 40 is merely the dividing place between the two parts 10B and 10C of the bar elongated extension 10. When the two pieces are interconnected, the release button 41 is disposed to emerge through the button opening 43 which is merely an orifice in the body of the elongated extension 10. The two pieces 10B and 10C are preferably shaped to slide together in telescope, for example, as shown in FIG. 1. The grasshopper leg spring 42, so named because of its strength and resilience, when bent and seated as shown in FIG. 14 is connected to the release button 41 in any known manner; preferably by impingement within a hollow 41A disposed within the button 41. The mid-portion 42A of the spring 42 may be bent to accomplish this fitted connection. The ends 42B and 42C of the spring 42 are then preferably bent as shown and fitted along portions within the elongated extension 10 to provide a firm tensioning seat. When the button 41 is depressed, the button 41 clears the opening 43 and the two extension pieces 10B and 10C (FIG. 1) pieces may be pulled apart at the separation seam 40. When the pieces 10B–10C are slid back together, by reason of the tension provided by the grasshopper leg spring 42, the button 41 pops through the opening 43 the instant the two 41, 43 become aligned. One may conceive of various other snap-fit means 400, of course. While many are, in fact, readily available on the market, for various contraptions and at least one incorporated within one of the more recent prior art models, the one presented herein is simple to manufacture and particularly suited to the assembly. Although great effort is not required to snap-fit the extension's 10 pieces together or pull them apart once the release button 41 is depressed, because of the structural integrity of the elongated extension 10, the connection is properly considered one of rigid emplacement.

The second of the major components, the elastic exercise cord assembly 2 may include only an elastic cord 20 whose ends 21A and 21B, in preparation for exercise, are connected-indirectly, ante—to the respective ends of the bar or elongated extension 10. In most embodiments, the cord 20 is of a hollow configuration, in which case an impingement plug 22 is also preferably present.

Lastly, each of the two cord emplacement blocks 3A and 3B is configured to seat within one of the emplacement nests 11A and 11B. The blocks 3A and 3B have an elastic exercise cord tunnel 32 through which the cord 20 is extended for connection. In shorthand parlance, the blocks 3A and 3B are characterized as a tunneled structure. Although, in such an embodiment, simple enreevement of the cord 20 through the tunnel 32 will suffice, a cord emplacement slot 34 (FIG. 6) may be provided to facilitate the emplacement. Moreover, although the cord 20 may merely be knotted at the end 21 to complete the connection, it is superior by far to employ a cord 20 which is hollow in configuration and to insert within its end 21A or 21B an impingement plug 22 to serve as a stopper. In either case, the connection provided between the cord 20 and the blocks 3A or 3B is appropriately characterized as one of rigid emplacement.

As matters of definition, the end of the tunnel 32 into which the cord 20 is inserted for the required connection is herein designated its cord conduit opening 35 and the opposing end thereof 32 through which the cord end 21 emerges, its cord impingement opening 33.

As FIGS. 7–12 demonstrate, the neck 30 of blocks 3A and 3B may have any one of a number of shapes along its axial cross-section. It is merely necessary that the nests 11A and 11B be mated to the base 30 configuration. If the shape is non-symmetrical, as in FIGS. 7–9, the number of ways the neck 30 will fit within the nests 11A and 11B is very limited. If the shape is symmetrical, however, neck 30 may conveniently be axially rotated to fit in anyone of a number of ways.

It is not essential upon assembly that the cord emplacement channels 14A and 14B and the block's cord emplacement slot 34, if included, be disposed in alignment with one another. It should be apparent that deliberately setting the slot 34 and the nests 14A and 14B in misalignment would enhance the cord 20 connecting security. Axial symmetry of the emplacement block's neck 30 then provides an additional convenience in which the cord 20 is emplaced more or less simultaneously and the block 3 then axially rotated within the nest 11 to a non-aligned position.

Figure 10:
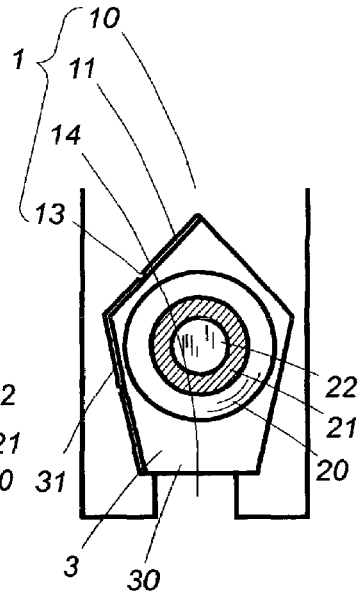
Figure 11:
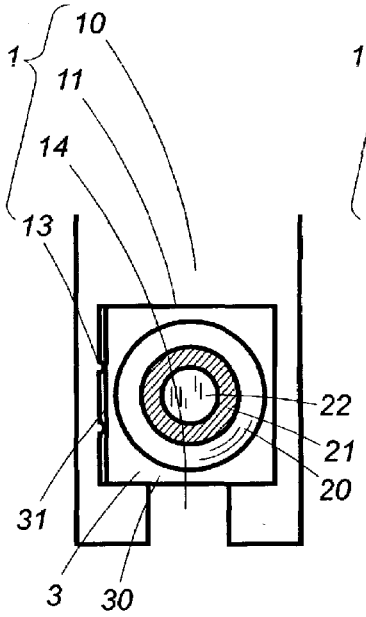
Figure 12:
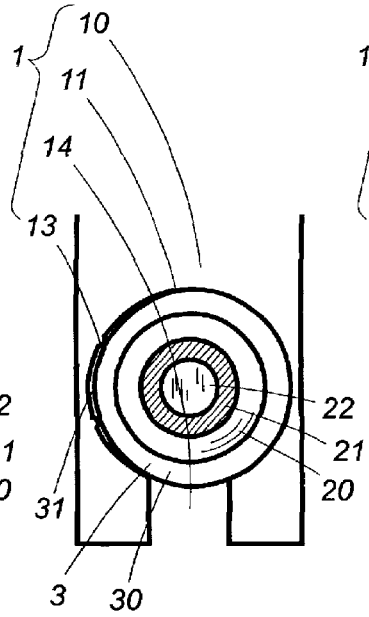
Figure 13:
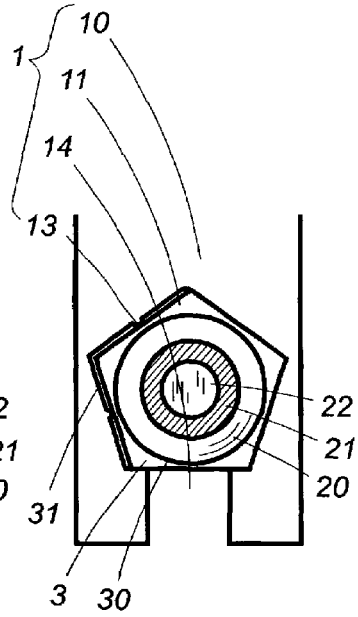

While axial symmetry of the block's neck 30, as shown in FIGS. 10–12, is a considerably preferred configuration, the nests 11A and 11B may be configured to mate to particular shapes. The blocks 3A and 3B may, for example, be shaped to accommodate the connection block, such as in the case in FIG. 1 or, perhaps, as also already extant in prior art, the cord connecting end of a solid handgrip assembly 120. Otherwise stated, the end of the connection blocks 130A and 130B of the strapped handgrip and that of the solid handgrip 120 (FIG. 4) into which the exercise cord 20 is reeved become emplacement blocks 3A and 3B.

In one embodiment, the blocks 3A and 3B are formed into a conical or truncated conical configuration that is sometimes referred to as frusto-conical. The emplacement nests 11A and 11B are mated to the blocks 3A and 3B. In shape, the emplacement of the blocks 3A and 3B within the nests 11A and 11B may be considered sufficiently secure for exercise.

Figure 6:
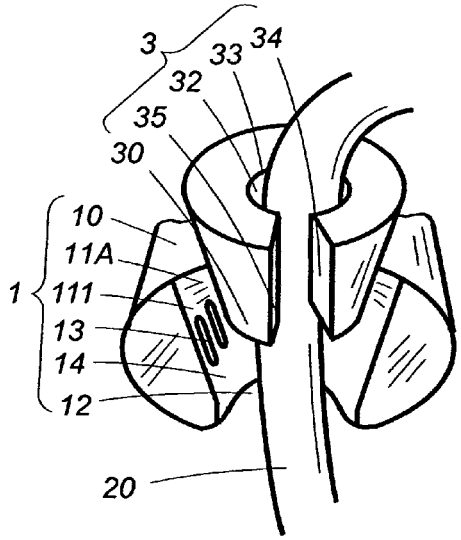
Figure 7:
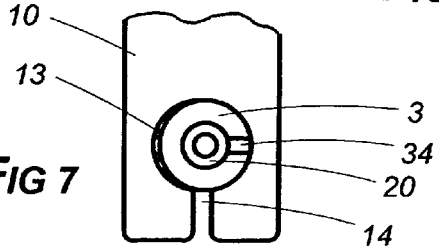
FIG. 7 represents a cross-sectional overhead view of an axially symmetrical neck of an emplacement block 3 in which an emplacement slot 34 is disposed in deliberate misalignment with the elongated extension's cord emplacement channel 14.
Figure 8:
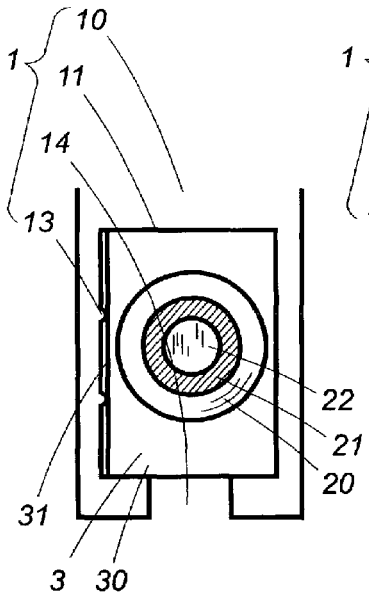
FIGS. 8–13 illustrate the cord emplacement blocks 3 mated with numerous shaped nests. The respective configurations of the first three of these are such that the block 3 and nest 11 co-engage in only one manner. The symmetry featured in the last three is such that the block 3 may be rotated to fit within the nest 11 in anyone of several ways.
Figure 9:
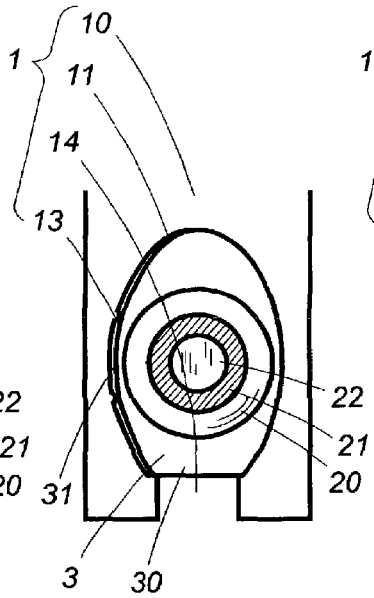

It should be apparent that when the elastic cord 20 is stretched during exercises in which the blocks 3A and 3B are disposed within the nests 11A and 11B, their dislodgement is highly unlikely—perhaps nearly impossible. As a matter of convenience, however, it is preferable that the blocks 3A and 3B be firmly retained in place when preparing for exercise or even during intermediate intervals of non-exercise. Within each nest 11A and 11B, therefore, one or more impingement nodes 13 are preferably present. The node 13 is merely a small protrusion along the wall is a nest 11A against which the emplacement block's neck 30, that is, the lower or most inserted portion of the block 3 becomes impinged when pressed into place. The portion of the neck 30 which contacts the node 13 is herein designated the block's impingement sector 31. A number of impingement sectors 31 may be disposed around the block's neck 30, consistent with the number of ways the block 3 emplacement is possible. When manufacture is by molding, the incorporation of nodes 13 and impingement sectors 31 is a simple matter. It is merely necessary that each contact one another 31, 13 tightly. The conical or tapered configuration for the block 3 and nest 11A then becomes unnecessary. Although nodes 13 are shown in FIG. 6 together with conical block 3 and nest 11 configuration, where impingement is accomplished by reason of the presence of one or more nodes 13 and impingement sectors 31, straight vertical walls are preferred. Impingement nodes 13 are visible in FIGS. 1, 2, 5, 6 and 7–12. As those illustrations show, a small clearance is necessarily formed proximate the nodes 13 at that portion of the nest wall upon which they 13 are situated. The reference to the "mating" of shapes as used herein, therefore, takes that small separation difference into account. Although the tolerances of these impingement features do not appear to rise to the definition herein of rigid emplacement, they must be such as to provide a suitably secure fit for exercise purposes.

If a wall 11A were provided without more, there would be concern that the emplacement block 3 might be pushed part way or all of the way through. In many of the exercise assembly's embodiments, therefore, a block retaining ledge 16 upon which the block 3 becomes firmly seated is also disposed deeply within the nest 11. FIG. 3 shows a block 3 inserted into a nest 17 in which not the bottom 3E thereof but an intermediate portion of its neck 30 is that which is configured to seat upon the ledge 16.

It is appropriate here to consider a second way to address the problem of axial rotation emplacement capability for the block 3. This can be achieved by conferring upon uppermost portion of block 3 what is designated herein as wrapping peg clearance configuration. For such an attribute, that portion of the block 3 is without the outward projections characterized by either the strapped handgrip's cord connector 130 or the outward and upward prongs of the solid handgrip 120. It is, therefore, appropriate to state as a matter of terminology that an emplacement block 3 so shaped comprises wrapping peg clearance configuration at the uppermost portion thereof. An assembly comprising such a block 3 would permit the inclusion of cord wrapping pegs 15A and 15D without the disadvantages mentioned supra. Moreover, a block 3 so configured may comprise either axial symmetry or non-symmetry. In embodiments in which symmetry is preferred, it is, therefore, advantageous to configure the block 3 from top to bottom with radial symmetry.

What is claimed is:

1. An exercise bar and cord assembly, comprising:

an exercise bar assembly including an elongated extension, the elongated extension having opposite ends, and a bar emplacement nest being disposed at each one of the opposite ends of the elongated extension;

an exercise cord assembly including an elastic exercise cord and rigid emplacements, a respective one of the rigid emplacements being disposed at each end of the elastic exercise cord; and cord emplacement blocks, each formed to have a neck and a cord tunnel, the neck being formed to fit within the bar emplacement nests, each one of the cord emplacement blocks emplaced in one of the bar emplacement nests, the elastic exercise cord being placed through the cord tunnel and each one of the rigid emplacements being disposed to retain the elastic exercise cord in the one of the cord emplacement blocks, wherein when an operator anchors a mid-portion of the elastic exercise cord grasps the opposing ends of the elongated extension, the operator can undertake a selected one of a number of exercises against the elastic resistance in the elastic exercise cord to exercise certain selected muscles of the operator.

2. The assembly according to claim 1, wherein the elongated extension comprises a cord emplacement channel disposed at the opposing ends of the elongated extension, the elastic exercise cord being emplaced within the elongated extension where preparation for use in either first or second mode exercise is facilitated.

3. The assembly according to claim 1, wherein the elongated extension further comprises a cord stretching recess formed between the opposing ends of the elongated extension, the mid-portion of the elastic exercise cord being emplaced along the cord stretching recess and the ends of the elastic exercise cord being anchored.

4. The assembly according to claim 1, wherein each one of the bar emplacements nests comprises a block retaining ledge and one or more block impingement nodes; and each of the cord emplacement blocks further comprises one or more impingement sectors each of the impingement sectors being formed to fit against the block retaining ledge and the block impingement nodes of one of the bar emplacement nests.

5. The assembly according to claim 1, wherein the elastic exercise cord is formed having a hollow configuration and each one of the rigid emplacements comprises an impingement plug disposed within each end of the elastic exercise cord.

6. The assembly according to claim 1, wherein each of the cord emplacement blocks further comprises a neck having an axial symmetry and the elongated extension comprises a continuously contoured projection, wherein the cord emplacement blocks are rotatable within the bar emplacement nests.

7. The assembly according to claim 1, wherein the elongated extension comprises cord wrapping pegs disposed at the opposing ends.

8. The assembly according to claim 1, wherein the bar emplacement nests are conical shaped and each of the cord emplacement blocks further comprises a neck sized to fit within one of the bar emplacement nests.

9. The assembly according to claim 1, wherein each of the cord emplacement blocks further comprises a cord emplacement slot, the cord emplacement slot being sized to allow the elastic exercise cord to slide into the cord tunnel.

10. The assembly according to claim 1, wherein each of the cord emplacement blocks comprises a wrapping peg clearance configuration and the neck is formed to have axial symmetry.

11. The assembly according to claim 1, wherein each of the cord emplacement blocks is configured from top to bottom with radial symmetry.

12. An exercise bar and cord assembly comprising:

an exercise bar assembly having two opposite ends and formed of two separable portions; a bar emplacement nest attached to each of said opposite ends;

an exercise cord assembly including an elastically deformable cord having opposite ends and a cord emplacement block affixed to each of said opposite ends of said elastically deformable cord, each of said cord emplacement blocks being formed to snuggly register with one of said bar emplacement nests upon movement of said exercise cord assembly relative to said exercise bar assembly by the user in performing exercises; and a bar separation assembly comprising snap-fit means for connecting said separable portions together, said bar separation assembly comprising a release button associated with one of said separable portions and a corresponding register to receive said release button formed in the other said separable portions, said bar separation assembly including an exercise bar grasshopper separation spring connected to said release button and one of said separable portions, and said bar separation assembly includes a separation spring seat; whereby upon depressing the button, said release button is cleared from said register, permitting said separable portions of the exercise bar's elongated extension to be separated from one another; and, upon rejoining the separable portions with and said release button and causing said release button to co-engage said register, the grasshopper spring urging said release button into an obstructing disposition wherein separation of the portions is inhibited.

13. The assembly according to claim 1, further comprising a bar separation assembly including a release button and a spring mechanism, wherein the elongate section is formed in at least two separable sections, the separable sections being formed having one end of one section that fits into another end of another section, the bar separation assembly being attached between each of the separable sections, and when the operator depresses the release button, the release button is cleared from an otherwise obstructing site, permitting the operator to separate the separable sections of the elongated extension from one another, and when the operator releases the release button and rejoins the separable sections causing the release button to co-engage a button opening, the spring mechanism returns the release button to an obstructing disposition wherein separation of the separable sections is restricted.

14. An exercise bar and cord assembly, comprising:

the exercise bar assembly having opposite ends, said exercise bar assembly being formed of two separable portions;

an emplacement nest disposed at each of the opposite ends of the exercise bar assembly;

an exercise cord assembly including an elastic exercise cord having opposite ends for elastic deformation by the user to perform exercises, said exercise cord assembly including a cord emplacement block secured to each of the opposite ends of said exercise cord assembly, said cord emplacement block being configured to removably and snuggly register within a respective nest; and a bar separation assembly for joining said two separable portions of said exercise bar assembly, each of said two separable portions having an inner end opposite said opposite end, and each of said two separable portions having an exterior surface, said bar separation assembly including a male portion formed at the inner end of one of said two separable portions and a female portion formed at the inner end of the other of said two separable portions sized to snuggly receive said male portion, and said bar separation assembly including locking means for locking said male portion and said female portion together, said locking means including an aperture formed in said female portion to extend therethrough, a register structure associated with said male portion, and spring means positioned to urge said register structure toward and into said aperture of said female portion when said male portion is inserted into said female portion, said register structure being operable by the user to urge it against the spring means and out of said aperture for removing said male portion from said female portion.

15. The assembly according to claim 14, wherein the exercise bar assembly includes a cord emplacement channel disposed at the opposing ends of the exercise bar assembly, the elastic exercise cord being inserted within the exercise bar assembly where preparation for exercise is facilitated.

16. The assembly according to claim 14, wherein the exercise bar assembly further comprises a cord stretching recess formed between the opposing ends of the exercise bar assembly, the mid-portion of the elastic exercise cord being inserted along the cord stretching recess and the ends of the elastic exercise cord being anchored.

17. The assembly according to claim 14, wherein the emplacement nest includes a block retaining ledge and one or more block impingement nodes, and the cord emplacement block further comprises one or more impingement sectors, each of the impingement sectors being formed to fit against the block retaining ledge and the block impingement nodes of one of the emplacement nests.

18. The assembly according to claim 14, wherein the exercise bar assembly includes cord wrapping pegs disposed at the opposing ends.

19. The assembly according to claim 14, wherein the cord emplacement block further comprises a cord emplacement slot, the cord emplacement slot being sized to allow the elastic exercise cord to slide into a cord tunnel.

20. The assembly according to claim 14, wherein the spring means is a grasshopper spring.

* * * * *

US006979286C1

(12) EX PARTE REEXAMINATION CERTIFICATE (9575th)

United States Patent
Hinds

(10) Number: US 6,979,286 C1
(45) Certificate Issued: Mar. 26, 2013

(54) EXERCISE BAR AND CORD ASSEMBLY

(75) Inventor: Robert Sylvester Hinds, Madison, WI (US)

(73) Assignee: Douglas C. Terry, Salt Lake City, UT (US)

Reexamination Request:
No. 90/011,672, Jun. 9, 2011

Reexamination Certificate for:

| | |
|---|---|
| Patent No.: | **6,979,286** |
| Issued: | **Dec. 27, 2005** |
| Appl. No.: | **10/184,239** |
| Filed: | **Jun. 26, 2002** |

(51) Int. Cl.
*A63B 21/02* (2006.01)

(52) U.S. Cl.
USPC ..... 482/121; 482/126; 482/125

(58) Field of Classification Search ..... None
See application file for complete search history.

(56) References Cited

To view the complete listing of prior art documents cited during the proceeding for Reexamination Control Number 90/011,672, please refer to the USPTO's public Patent Application Information Retrieval (PAIR) system under the Display References tab.

*Primary Examiner* — Danton Demille

(57) ABSTRACT

An exercise bar and cord assembly having a cavity or nest at each end of the bar for connection with a snugly fitting cord emplacement block. The exercise cord, stoppered with a plug in conventional manner, is connected to the block, extending through a tunnel within it. The block may be shaped in any of several ways and a strapped handgrip connection block will serve the purpose. Emplacement channels or slots are optionally present in both the bar and the block. If the block has an axially symmetrical neck, it may be rotated so that the channels are misaligned for improved cord retention. Two modes of exercise are defined in terms of the cord's anchoring means—that is, whether its ends or a mid-portion of it.

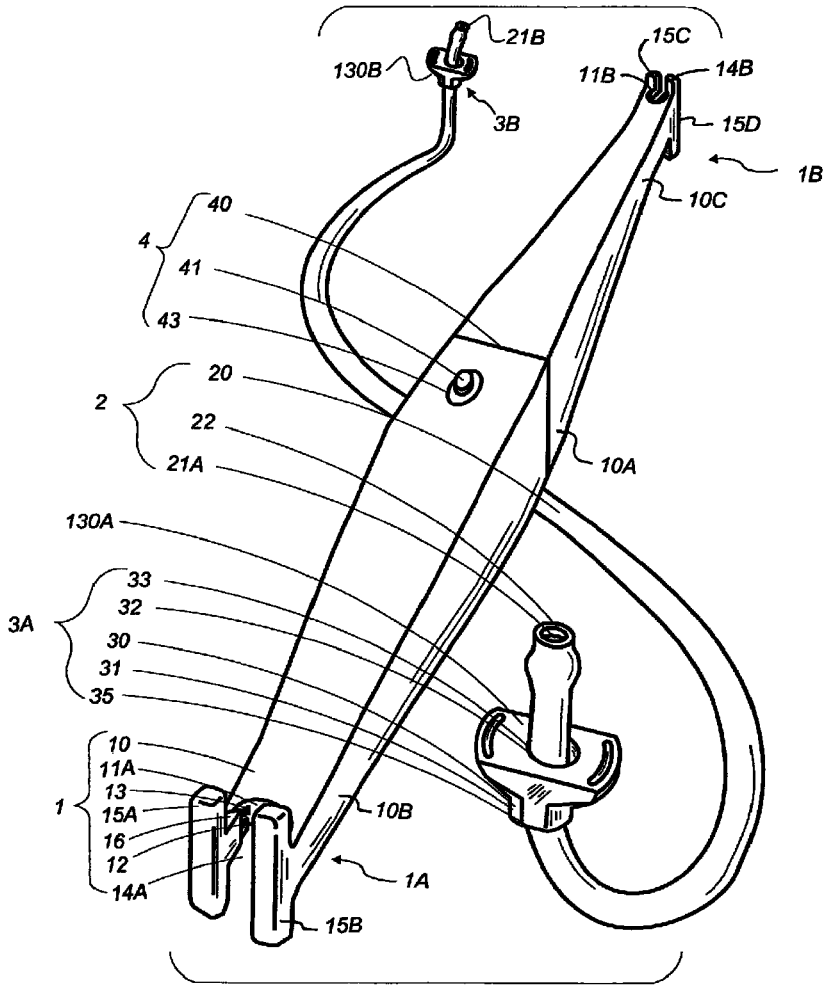

EX PARTE REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1-20 are cancelled.

* * * * *